US007720414B2

(12) United States Patent
Kubo et al.

(10) Patent No.: US 7,720,414 B2
(45) Date of Patent: May 18, 2010

(54) FIXING APPARATUS HAVING GUIDE MEMBER

(75) Inventors: Takashi Kubo, Kyoto (JP); Yasunori Minakuchi, Nara (JP); Hiroaki Hori, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 51 days.

(21) Appl. No.: 11/675,137

(22) Filed: Feb. 15, 2007

(65) Prior Publication Data

US 2007/0196127 A1 Aug. 23, 2007

(30) Foreign Application Priority Data

Feb. 22, 2006 (JP) ..... 2006-045660

(51) Int. Cl.
*G03G 21/00* (2006.01)

(52) U.S. Cl. ..... 399/124

(58) Field of Classification Search ..... 399/124, 399/323, 21, 122, 75; 432/60
See application file for complete search history.

(56) References Cited

U.S. PATENT DOCUMENTS 4,110,068 A * 8/1978 Brown et al. ..... 432/60
4,154,575 A * 5/1979 Edwards et al. ..... 432/60
4,421,401 A * 12/1983 Kagiura et al. ..... 399/122
4,598,990 A * 7/1986 Kusumoto et al. ..... 399/75
4,756,687 A * 7/1988 Cabrera et al. ..... 432/60
7,003,246 B2 * 2/2006 Gogate et al. ..... 399/122
2006/0008294 A1 * 1/2006 Ito et al. ..... 399/122

FOREIGN PATENT DOCUMENTS

EP 278237 A1 * 8/1988
JP 63014184 A * 1/1988
JP 01185580 A * 7/1989
JP 02-081855 3/1990
JP 06266259 A * 9/1994
JP 2001-125421 5/2001
JP 2004361442 A * 12/2004

* cited by examiner

*Primary Examiner*—Quana M Grainger
(74) *Attorney, Agent, or Firm*—Renner, Otto, Boisselle & Sklar, LLP

(57) ABSTRACT

In one embodiment, the fixing apparatus of the present invention is a fixing apparatus in which while recording paper is transported sandwiched between a heating roller and a pressure roller that are pressed against each other, the recording paper is guided by a guide member, and heat and pressure are applied to the recording paper to fix toner on the recording paper, the fixing apparatus configured with the guide member rotatably provided such that the guide member can be removed from the transport path of the recording paper, and the center of rotational movement of the guide member matched with a shaft of the heating roller or a shaft of the pressure roller.

2 Claims, 9 Drawing Sheets

FIXING APPARATUS HAVING GUIDE MEMBER

This application claims priority under 35 U.S.C. §119(a) on Japanese Patent Application No. 2006-045660 filed in Japan on Feb. 22, 2006, the entire contents of which are hereby incorporated by reference.

BACKGROUND OF THE INVENTION

1. Field of the Invention

The present invention relates to a fixing apparatus used in an electrophotographic image forming apparatus.

2. Description of the Related Art

This type of image forming apparatus is provided as a copy machine, a printer, a facsimile apparatus, or the like. In this apparatus, an electrostatic latent image is formed on a photosensitive body, the electrostatic latent image on the photosensitive body is developed using toner to form a toner image on the photosensitive body, the toner image is transferred from the photosensitive body to recording paper, and heat and pressure are applied to the recording paper to fix the toner image on the recording paper.

Recently, reduction in the size of those various image forming apparatuses has been advancing, reducing excess space inside the apparatus, so that many components are arranged close to each other. Thus, when a jam occurs, in which recording paper in the midst of transport becomes blocked, it is difficult to remove the recording paper. Several opening-closing locations are provided along the transport path so that the transport path is opened by opening these opening-closing locations, but because many components are also disposed around the transport path, even if the transport path is opened, those components may be a hindrance to removing the recording paper. Also, there is a risk that when removing the recording paper, the recording paper will be rubbed against a peripheral component, leading to a reduction in component precision or damaging a component.

In a fixing apparatus, while transporting recording paper sandwiched between a heating roller and a pressure roller, heat and pressure are applied to the recording paper to fix toner on the recording paper by melting the toner with heat, so a jam may occur due to the recording paper rolling around the heating roller or the pressure roller, and thus an opening-closing location is also provided in the vicinity of the fixing apparatus so that it is possible to remove the recording paper.

Also, in the fixing apparatus, a guide member is provided in order to guide the recording paper, but because this guide member hinders the removal of recording paper, a configuration is adopted in which it is possible to move the guide member when removing the recording paper.

For example, in a fixing apparatus according to the related art as shown in FIG. 9, the recording paper is transported sandwiched between a heating roller 101 and a pressure roller 102, the recording paper is guided between a paper separation plate 104 and a guide member 103, and the recording paper is further transported by a transport roller 105. The guide member 103 is rotationally supported axially by a shaft 103*a*. When a recording paper jam has occurred, the guide member 103 is rotated around the shaft 103*a* in the direction of arrow C, removing the guide member 103 from the recording paper transport path as indicated by the double-dotted line, and thus the area around the transport path is widely vacated so that the recording paper can easily be removed.

Also, in JP H02-81855A, on the downstream side of the fixing apparatus in the transport direction of the recording paper, a transport mechanism including the transport roller or the like is removed from the fixing apparatus, thus opening the downstream side of the fixing apparatus, so that it is possible to remove recording paper jammed in the fixing apparatus.

However, in order to rotate the guide member 103 around the shaft 103*a* along the trajectory tr of the double-dotted line as shown in FIG. 9, a large space for evacuating the guide member 103 is necessary, and this space prevents a reduction in the size of the image forming apparatus. Also, the space therefore cannot be made sufficiently large, and even if the guide member 103 is rotated, it is not possible to widely vacate the area around the transport path, and thus the recording paper cannot be easily removed. In addition, when the user makes an excessive attempt to remove the recording paper, there is a risk that the user's hand will touch the heating roller, or that the heating roller 101, the pressure roller 102, the paper separation plate 104, a temperature sensor (not shown), or the like will be damaged.

Also, even in a state with the guide member 103 positioned at a prescribed position when guiding the recording paper, the guide member 103 occupies a large amount of space, and this also prevents a reduction in the size of the image forming apparatus.

Also, as disclosed in JP H02-81855A, in a case in which a transport mechanism including the transport roller or the like is removed from the fixing apparatus, a large space for evacuating the guide member is necessary, thus preventing a reduction in the size of the image forming apparatus.

SUMMARY OF THE INVENTION

The present invention was made in consideration of the problems in the related art described above, and it is an object thereof to provide a fixing apparatus in which when removing recording paper, it is possible to widely open the area around the transport path, and in which the amount of space for doing so can be reduced, thus also realizing a reduction in the size of the image forming apparatus.

In order to address the problems described above, the present invention provides a fixing apparatus in which while recording paper is transported sandwiched between a heating roller and a pressure roller that are pressed against each other, the recording paper is guided by a guide member, and heat and pressure are applied to the recording paper to fix toner on the recording paper, wherein the guide member is rotatably provided such that the guide member can be removed from the transport path of the recording paper, and the center of rotational movement of the guide member is matched with a shaft of the heating roller or a shaft of the pressure roller.

With this configuration, the guide member rotates around the shaft of the roller with which the center of rotational movement of the guide member is matched, so that the guide member moves along the circumferential face of the roller. Thus, a configuration is fine as along as there is space along the circumferential face of the roller for moving the guide member, so the guide member can easily move without interfering with the surrounding components. Also, it is possible to increase the movement distance of the guide member, so that the guide member is sufficiently removed from the transport path of the recording paper and thus the area around the transport path can be widely vacated. Therefore, it is easy to remove recording paper jammed in the transport path.

Also, in the present invention an opening-closing door may be provided in the vicinity of the transport path of the recording paper, such that when the opening-closing door has been closed, the guide member is positioned due to the guide member making contact with part of the opening-closing door.

With this configuration, an opening-closing door is provided in the vicinity of the transport path of the recording paper. This opening-closing door is opened to open the transport path, and then recording paper jammed in the transport path is removed. When the opening-closing door has been closed, the guide member is positioned due to the guide member making contact with part of the opening-closing door. Thus, the guide member is accurately positioned at a prescribed position, so that the recording paper is reliably guided.

Further, in the present invention, a applying energy means is provided that, when the opening-closing door has been opened, applies energy to rotate the guide member in a direction that removes the guide member from the transport path of the recording paper.

With a applying energy means having this configuration, it is possible to directly open the transport path when the opening-closing door has been opened, so that the recording paper can easily be removed.

Also, in the present invention, the guide member is rotatably supported by a shaft of the heating roller or a shaft of the pressure roller.

With this configuration, it is not necessary to particularly provide a rotating shaft that axially supports the guide member, and thus it is possible to suppress increasing complication of the configuration.

(Deleted)

Figure 1:
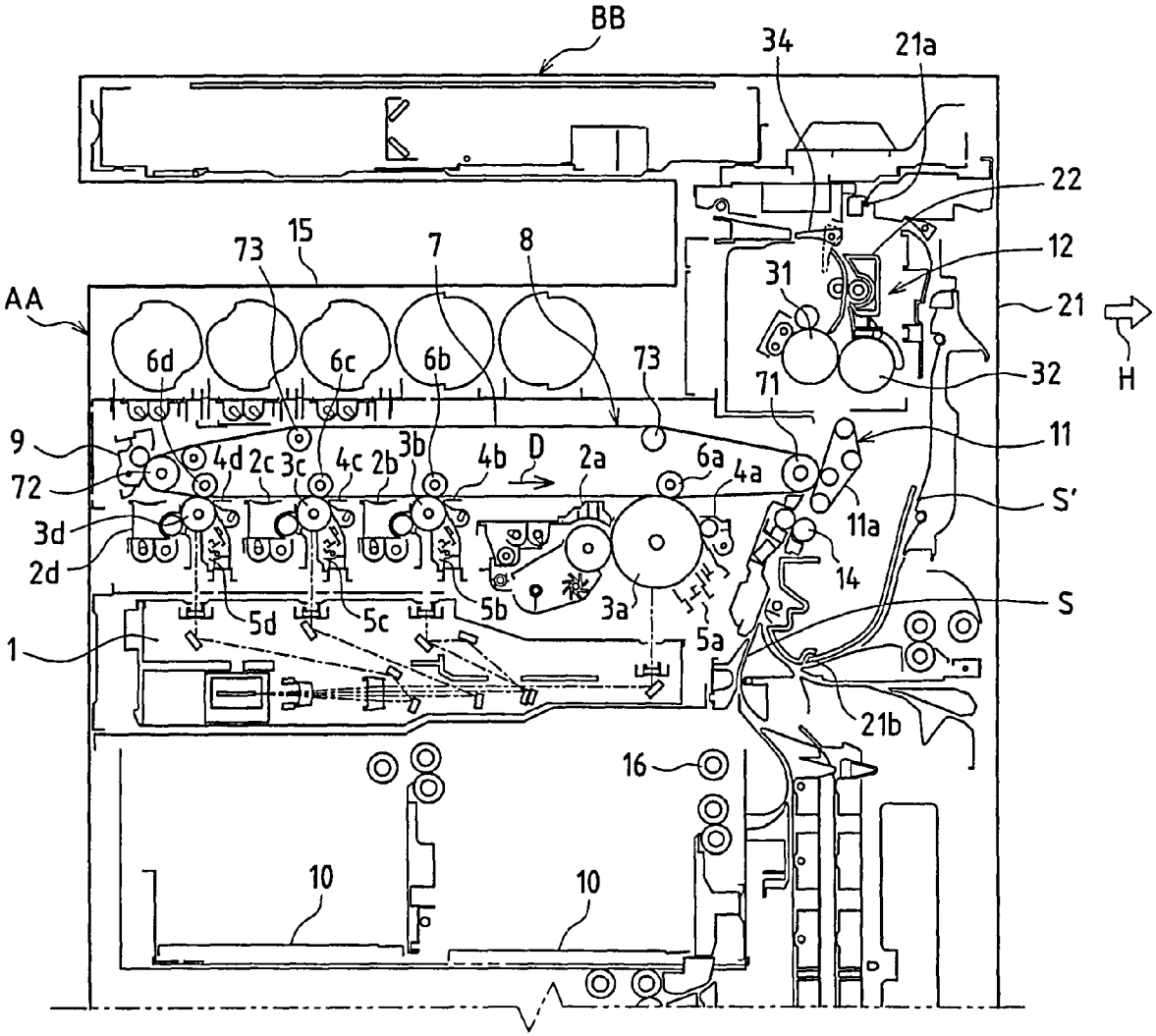
FIG. 1 is a side view showing the configuration of an image forming apparatus in which one embodiment of a fixing apparatus according to the present invention has been applied.
Figure 6:
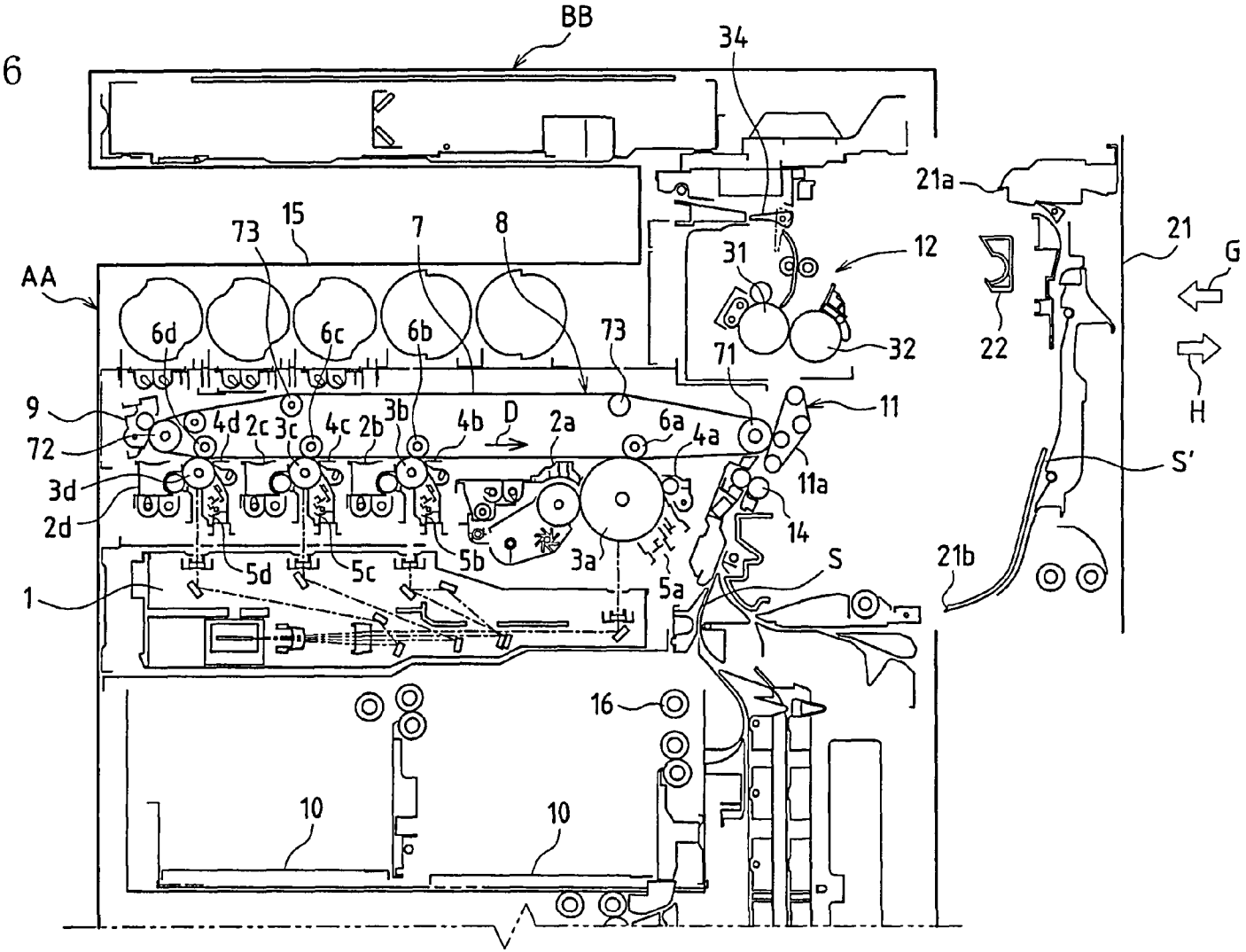

FIG. 6 is a side view showing a state in which an opening-closing door of the image forming apparatus in FIG. 1 is pulled out.

Figure 2:
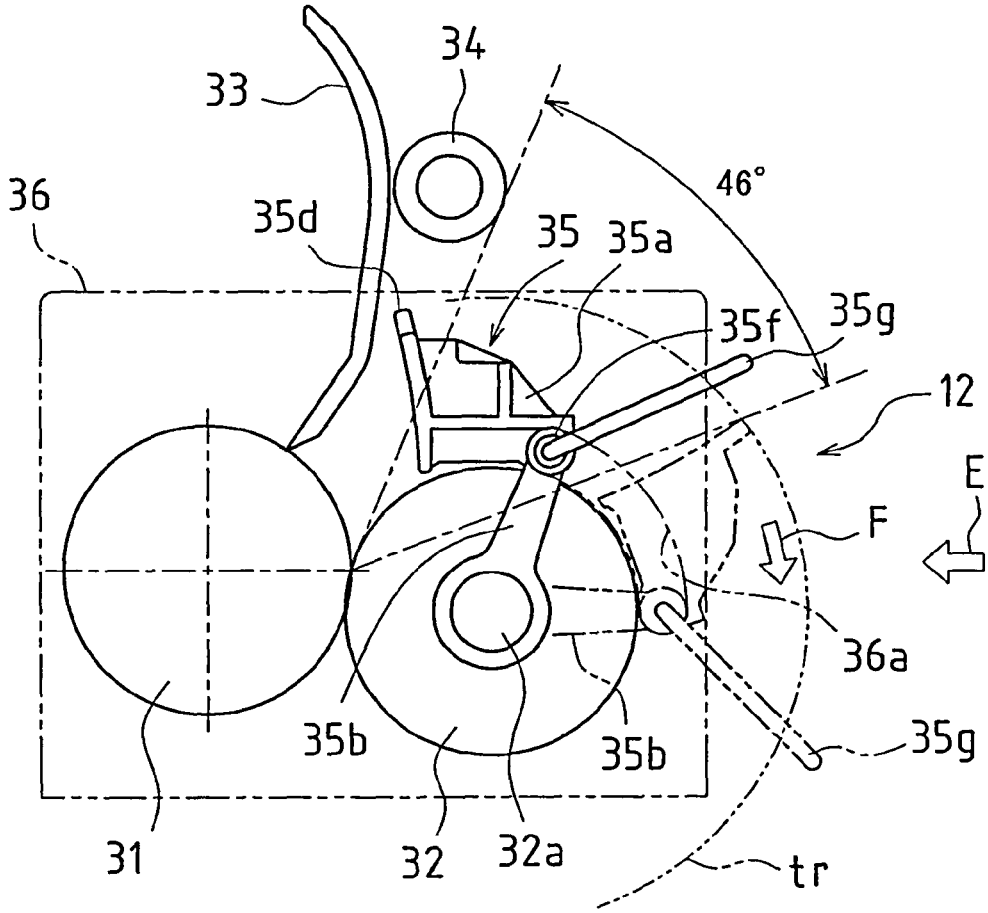
FIG. 2 is a side view in which part of a fixing apparatus according to the present invention is shown enlarged.
Figure 7:
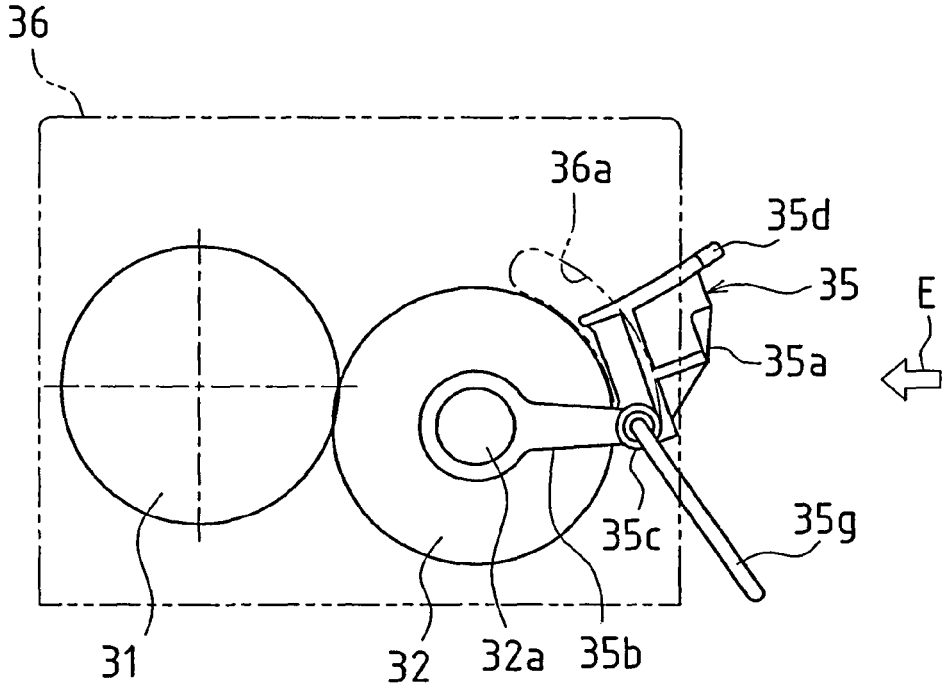

FIG. 7 is a side view showing a state in which the movable guide plate in the fixing apparatus in FIG. 2 has been rotated.

Figure 8:
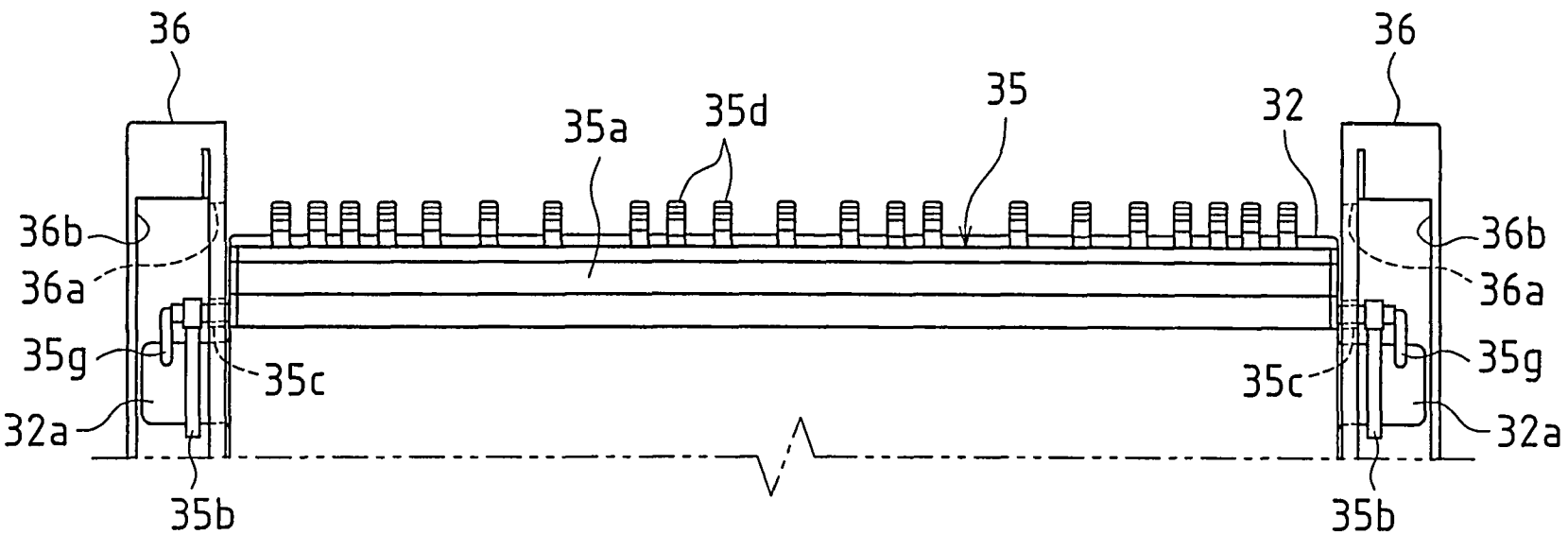

FIG. 8 is a rear view showing the movable guide plate in FIG. 7.

Figure 9:
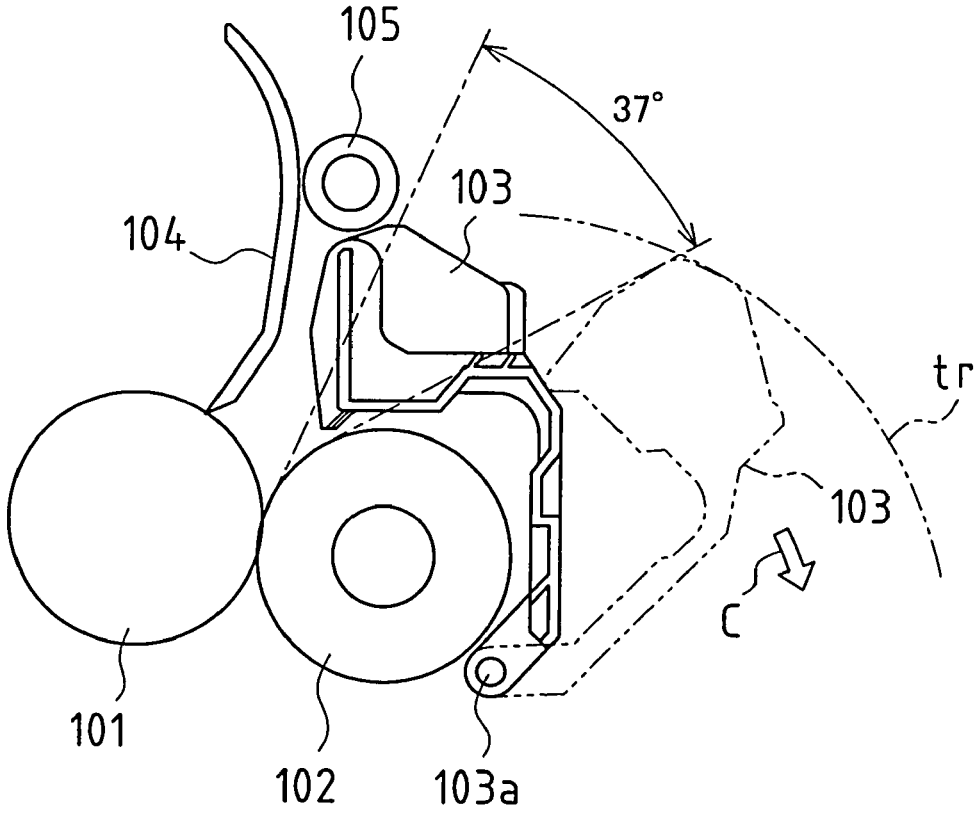
FIG.9 Prior Art

FIG. 9 is a side view in which part of a fixing apparatus according to the related art is shown enlarged.

DESCRIPTION OF THE PREFERRED EMBODIMENTS

Hereinafter, embodiments of the present invention will be described in detail with reference to the accompanying drawings.

FIG. 1 is a side view showing the configuration of an image forming apparatus in which one embodiment of a fixing apparatus according to the present invention has been applied. This image forming apparatus AA forms and records on recording paper, in color or monochrome, an image of an original read from an original reading apparatus BB or an image received from outside. The image forming apparatus is configured from, for example, an exposure unit 1, a development apparatus 2, a photosensitive drum 3, a charging unit 5, a cleaning unit 4, an intermediate transfer belt unit 8, a fixing apparatus 12, a paper transport path S, a paper feed tray 10, and a discharge tray 15.

The image data handled in the image forming apparatus AA corresponds to a color image using each color black (K), cyan (C), magenta (M), and yellow (Y), or corresponds to a monochrome image using a single color (for example, black). Accordingly, four units of each of the development apparatus 2 (2*a*, 2*b*, 2*c*, 2*d*), the photosensitive drum 3 (3*a*, 3*b*, 3*c*, 3*d*), the charging unit 5 (5*a*, 5*b*, 5*c*, 5*d*), and the cleaning unit 4 (4*a*, 4*b*, 4*c*, 4*d*) are provided in order to form four types of latent images corresponding to each color. With "a" corresponding to black, "b" corresponding to cyan, "c" corresponding to magenta, and "d" corresponding to yellow, four image stations are configured.

The photosensitive drum 3 is disposed in approximately the center portion of the image forming apparatus AA.

The charging unit 5 is a charging means for uniformly charging the surface of the photosensitive drum 3 to a predetermined potential, and other than a roller-type or brush-type charging unit, which are contact-type charging units, a charger-type charging unit as shown in FIG. 1 can be used.

The exposure unit 1, for example, uses a laser scanning unit (LSU) provided with an EL or LED write head in which light-emitting elements are lined up in an array, or a laser irradiation unit, and a reflecting mirror. The exposure unit 1, by exposing the charged photosensitive drum 3 according to the image data input, forms an electrostatic latent image corresponding to the image data on the surface of the photosensitive drum 3.

The development apparatus 2 causes the electrostatic latent image formed on each photosensitive drum 3 to become visible using (K, C, M, Y) toner. The cleaning unit 4 removes and recovers toner remaining on the surface of the photosensitive drum 3 after development and image transfer.

The intermediate transfer belt unit 8, disposed above the photosensitive drum 3, includes an intermediate transfer belt 7, an intermediate transfer belt drive roller 71, an intermediate transfer belt tension roller 73, an intermediate transfer belt driven roller 72, an intermediate transfer roller 6 (6*a*, 6*b*, 6*c*, 6*d*), and an intermediate transfer belt cleaning unit 9.

The intermediate transfer belt 7 is stretched across and supported by, for example, the intermediate transfer belt drive roller 71, the intermediate transfer belt tension roller 73, the intermediate transfer roller 6, and the intermediate transfer belt driven roller 72, which allow the intermediate transfer belt 7 to rotate in the direction of arrow D.

The intermediate transfer roller 6 is supported such that it can rotate in the vicinity of the intermediate transfer belt 7, and provides a transfer bias for transferring the toner image of the photosensitive drum 3 to the intermediate transfer belt 7.

The intermediate transfer belt 7 is provided such that it makes contact with the respective photosensitive drums 3, and transfers the toner images of each color formed on the photosensitive drums 3 layered onto the intermediate transfer belt 7 in order, thus forming a color toner image (a multi-color toner image). This transfer belt is formed to be endless using a film with a thickness of 100 μm to 150 μm.

The transfer of the toner image from the photosensitive drums 3 to a sheet (recording paper) is performed by the intermediate transfer rollers 6, which are in contact with the back side of the intermediate transfer belt 7. In order to transfer the toner image, a high voltage transfer bias (high voltage with opposite polarity (+) to the charge polarity (−) of the toner) is applied to the intermediate transfer rollers 6. The intermediate transfer rollers 6 use a metal (stainless steel, for example) shaft with a diameter of 8 to 10 mm as a base, and the surface of those rollers is covered with conductive elastic material (such as EPDM or urethane foam, for example). With this conductive elastic material, it is possible to uniformly apply a high voltage to the recording paper. In the present embodiment, the intermediate transfer rollers 6 are used as transfer electrodes, but other than those rollers, a brush or the like may also be used.

The toner image caused to become visible with the toner of each color on the photosensitive drums 3 (3*a*, 3*b*, 3*c*, 3*d*) in the above manner are layered with the intermediate transfer belt 7, and thus an image received from outside or an image of an original read from the original reading apparatus BB is expressed. With rotation of the intermediate transfer belt 7, the toner images of each color layered in this manner are transferred onto paper by a secondary transfer unit 11 disposed at a position where the recording paper and the intermediate transfer belt 7 make contact, described later.

The intermediate transfer belt 7 and a transfer belt 11*a* of the secondary transfer unit 11 are pressed against each other, forming a nip region. Also, a voltage (a high voltage with opposite polarity (+) to the charge polarity (−) of the toner) is applied to the transfer belt 11*a* of the secondary transfer unit 11 in order to transfer the toner image of each color on the intermediate transfer belt 7 to the recording paper. Further, in order to steadily obtain the above nip region, hard material (such as metal) is used for either the rollers of the secondary transfer unit 11 or the intermediate transfer belt drive roller 71, and soft material (such as an elastic rubber roller or a foam resin roller) of an elastic roller or the like is used for the other.

Also, toner may sometimes remain on the intermediate transfer belt 7 without the toner images of each color on the intermediate transfer belt 7 being completely transferred onto the recording paper by the secondary transfer unit 11, and this residual toner causes color mixing in the next step. Thus, the residual toner is removed and recovered by the intermediate transfer belt cleaning unit 9. The intermediate transfer belt cleaning unit 9, for example, is provided with a cleaning blade that makes contact with the intermediate transfer belt 7 and is used as a cleaning member, and at the position where the cleaning blade makes contact, the intermediate transfer belt 7 is supported from the back side of the belt 7 by the intermediate transfer belt driven roller 72.

The paper supply tray 10 is a tray for storing recording paper, and is provided below the image forming unit of the image forming apparatus AA. Also, the discharge tray 15, provided above the image forming unit, is a tray in which recording paper whose printing is finished is placed face down.

Also, in the image forming apparatus AA, an S-shaped paper transport path S is provided for feeding recording paper in the paper feed tray 10 through the secondary transfer unit 11 and the fixing apparatus 12 to the discharge tray 15. Further, disposed in the vicinity of the paper transport path S from the paper feed tray 10 to the discharge tray 15 are a pickup roller 16, registration rollers 14, the fixing apparatus 12, a transport direction switching guide 34, and rollers or the like (not shown) that transport the recording paper.

The transport rollers are small rollers that expedite and assist transport of the recording paper, and a plurality of the transport rollers are provided along the paper transport path S. The pickup roller 16 is provided at the end of the paper feed tray 10, and supplies recording paper from the paper feed tray 10 page by page to the paper transport path S.

The transport direction switching guide 34 is rotatably provided in a side cover, and by moving from the state shown by the solid line to the state shown by the broken line, the transport direction switching guide 34 separates recording paper from the midst of the transport path S. At this time, the recording paper passes through the fixing apparatus 12 and a transport path S' formed between the side cover and the transport switching guide 34, and after the front and back of the recording paper are reversed, the recording paper is returned to the paper transport path S.

Also, the registration rollers 14 temporarily stop the transported recording paper and align the leading edge of the recording paper. The registration rollers 14 transport the recording paper with good timing matched with the rotation of the photosensitive drum 3, such that good multiplex transfer of the toner image on the photosensitive drum 3 to the recording paper is possible.

For example, the registration rollers 14, based on a detection signal output by an unshown pre-registration detection switch, are set to transport the recording paper such that the leading edge of the toner image on each photosensitive drum 3 (3*a*, 3*b*, 3*c*, 3*d*) matches the leading edge in the image forming range in the recording paper.

The fixing apparatus 12 is provided with, for example, a heating roller 31 and a pressure roller 32. The heating roller 31 and the pressure roller 32 rotate while sandwiching the recording paper.

Also, based on a signal from an unshown temperature detection unit, the heating roller 31 is controlled to a predetermined fixing temperature by a controller, and by applying heat and pressure to the recording paper along with the pressure roller 32, the heating roller 31 melts, blends, and applies pressure to the multi-color toner image transferred to the recording paper, thus hot-fixing the multi-color toner image to the recording paper.

After fixing of the multi-color toner image, the recording paper is transported by the transport rollers to a reverse discharge path of the paper transport path S, and in a reversed state (with the multi-color toner image facing downward), the recording paper is discharged onto the discharge tray 15.

FIG. 2 is a side view in which part of the fixing apparatus 12 according to the present embodiment is shown enlarged. In the fixing apparatus 12, the heating roller 31 and the pressure roller 32 are pressed against each other, forming a nip region between the rollers 31 and 32. While transporting the recording paper sandwiched in the nip region between the rollers 31 and 32, heat and pressure are applied to the recording paper by the rollers 31 and 32, thus fixing the toner image on the recording paper. A paper separation plate 33 is disposed fixed above the rollers 31 and 32, and a transport roller 34 is in contact with the paper separation plate 33. Also, a movable guide member guide member 35 is disposed slightly separated from the circumferential face of the pressure roller 32. The recording paper is guided between the paper separation plate 33 and the movable guide member 35, arrives between the paper separation plate 33 and the transport roller 34, and is further transported by the transport roller 34.

Figure 3:
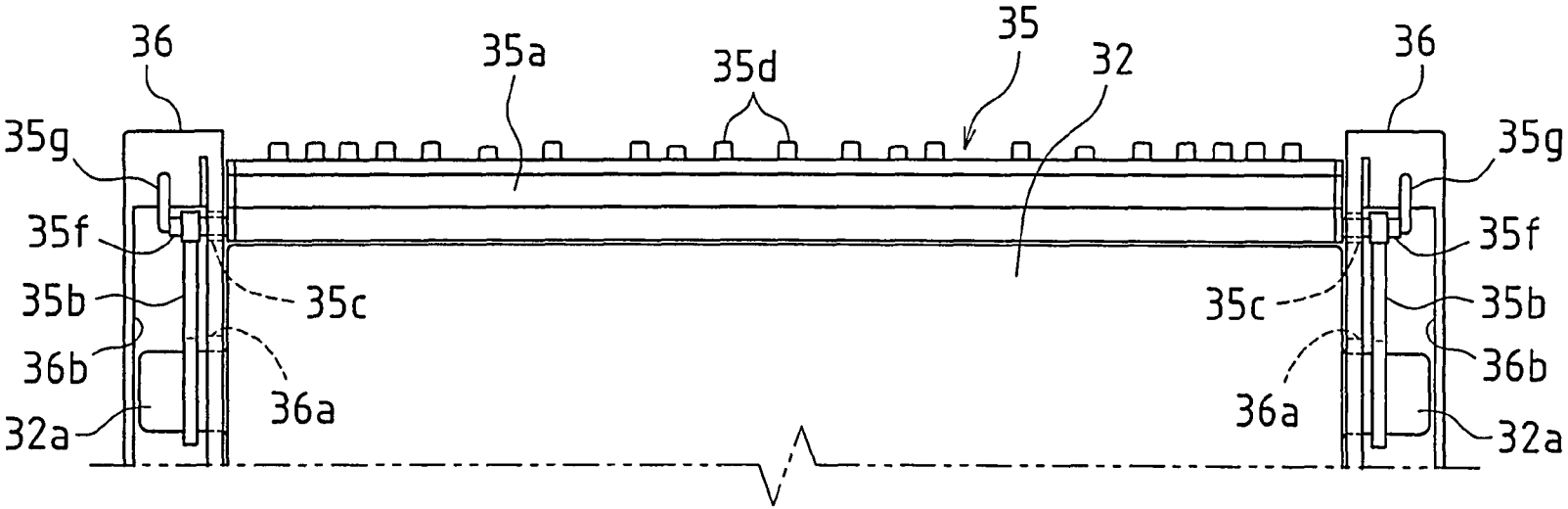
FIG. 3 is a rear view showing a pressure roller and a movable guide plate in the fixing apparatus in FIG. 2.
Figure 4:
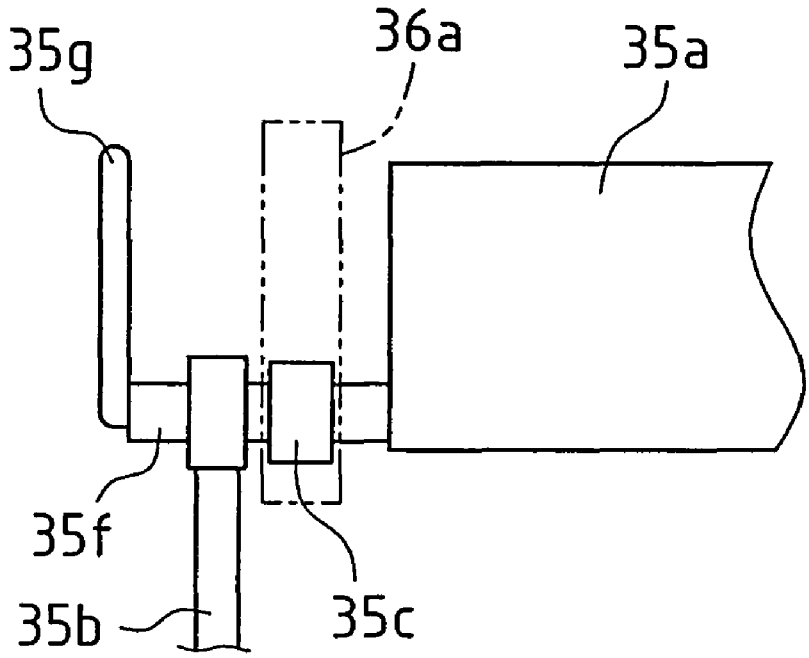
FIG. 4 is a rear view in which a support mechanism of the movable guide plate in FIG. 3 is shown enlarged.

FIG. 3 is a rear view showing the pressure roller 32 and the movable guide plate 35, viewed in the direction of arrow E in FIG. 2. FIG. 4 is a rear view in which the pressure roller 32 and the movable guide plate 35 in FIG. 3 are shown partially enlarged. As shown in FIGS. 2, 3, and 4, the movable guide plate 35 includes a guide unit 35*a* of about the same length as the pressure roller 32, middle shafts 35*a* and 35*b* that form a connection between both ends of support shafts 35*f* of the guide unit 35*a* and both ends of a shaft 32*a* of the pressure roller 32, wheels 35*c* provided at both ends of the support shaft 35*f* of the guide unit 35*a*, and handles 35*g* provided protruding from both ends of the support shaft 35*f* of the guide unit 35*a*. The guide unit 35*a* includes a plurality of guide catches 35*d* that make contact with the recording paper. Also, the handles 35*g* at both ends of the guide unit 35*a* protrude through openings 36*b* of frames 36.

Here, the shaft 32*a* of the pressure roller 32 is axially supported by each frame 36 provided on both sides of the pressure roller 32, and thus the pressure roller 32 is rotationally supported. One end of the joint shafts 35*b* of the movable guide plate 35 is inserted through the shaft 32*a* of the pressure roller 32, so that the joint shafts 35*b* are rotatable with respect to the pressure roller 32, and thus the movable guide plate 35 is rotatable around the shaft 32*a* of the pressure roller 32. Also, the other end of each joint shaft 35*b* is fixed to each end of the support shaft 35*f* of the guide unit 35*a*.

Further, the wheels 35*c* of the movable guide plate 35 are inserted into an arc-shaped groove 36*a* of each frame 36 on both sides of the pressure roller 32. The arc-shaped groove 36*a* of each frame 36 is formed concentrically with the shaft 32*a* of the pressure roller 32, and the wheels 35*c* of the movable guide plate 35 slide along the respective arc-shaped grooves 36*a*, and thus the movable guide plate 35 rotates around the shaft 32*a* of the pressure roller 32.

Accordingly, both ends of the movable guide plate 35 are supported such that they can rotate around the shaft 32*a* of the pressure roller 32 by the joint shaft 35*b*, and also by the wheel 35*c* and the arc-shaped groove 36*a*.

Also, both ends of the support shaft 35*f* of the movable guide plate 35 are fixed to the ends of the joint shaft 35*b*, so the position of the movable guide plate 35 is always maintained relative to the circumferential face of the pressure roller 32, without the movable guide plate 35 rotating around the wheel 35*c*.

Thus, it is possible for the movable guide plate 35 to rotate with the trajectory tr along the circumferential face of the pressure roller 32.

Also, a movable guide plate applying energy spring (not shown) is provided between the joint shaft 35*b* of the movable guide plate 35 and the shaft 32*a* of the pressure roller 32. The ends of the movable guide plate applying energy spring are respectively caught on the joint shaft 35*b* and the shaft 32*a* of the pressure roller 32, and thus restoring force is delivered to the joint shaft 35*b* in the direction of arrow F by the movable guide plate applying energy spring.

Figure 5A:
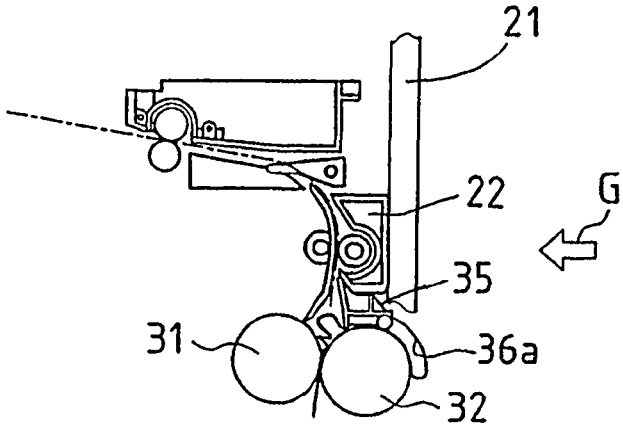
FIG. 5A illustrates a process of rotational movement of the movable guide plate in the fixing apparatus in FIG. 2.

In a state of normal operation of the image forming apparatus AA as shown in FIG. 1, an opening-closing door 21 of the apparatus AA is closed, and as shown in FIG. 5A, a guide of the opening-closing door 21 and a pressing member 22 press against the movable guide plate 35 in the direction of arrow G, the movable guide plate 35 rotates in the opposite direction of the arrow F against the elastic force of the movable guide plate applying energy spring, the wheels 35*c* of the movable guide plate 35 collide with the upper end of the arc-shaped grooves 36*a* of the frames 36, and thus the movable guide plate 35 is positioned at a prescribed position relative to the transport path of the fixing apparatus 12, as shown in FIGS. 2 and 3. In this state, the recording paper is guided between the paper separation plate 33 and the movable guide member 35.

On the other hand, in such an image processing apparatus AA, a jam may occur in which recording paper in the midst of transport becomes blocked. Thus, a configuration is adopted in which several opening-closing locations are provided along the transport path, and by opening these opening-closing locations, it is possible to open the transport path and remove recording paper.

One of those opening-closing locations is the opening-closing door 21. When the opening-closing door 21 is pulled in the direction of arrow H, vertical catches 21*a* and 21*b* of the opening-closing door 21 are separated from the respective locations where they engage with the main body of the image forming apparatus AA, and the opening-closing door 21 is pulled out in the direction of arrow H.

FIG. 6 shows a state in which the opening-closing door 21 is pulled out from the image forming apparatus AA in the direction of arrow H. In this state, it is possible to remove recording paper jammed in the transport path in the range of registration rollers 14→secondary transfer unit 11→fixing apparatus 12→transport direction switching guide 34.

Figure 5B:
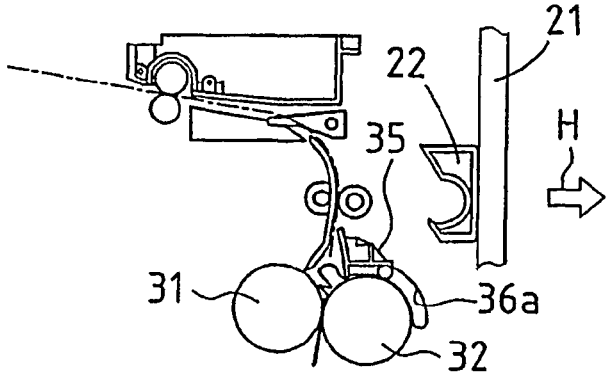
FIG. 5B illustrates a process of rotational movement of the movable guide plate in the fixing apparatus in FIG. 2.
Figure 5C:
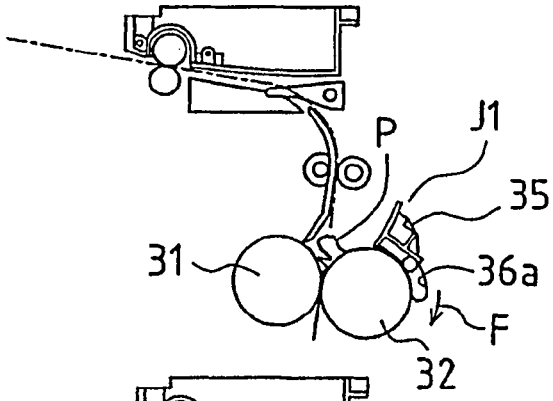
FIG. 5C illustrates a process of rotational movement of the movable guide plate in the fixing apparatus in FIG. 2.
Figure 5D:
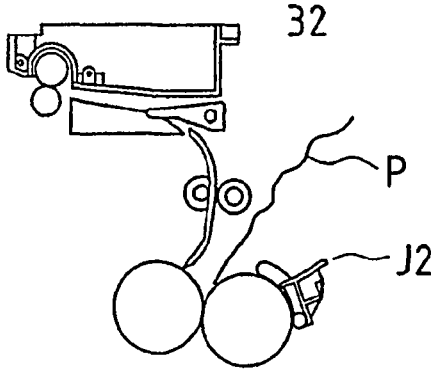
FIG. 5D illustrates a process of rotational movement of the movable guide plate in the fixing apparatus in FIG. 2.

Also, when the opening-closing door 21 has been pulled out, the guide of the opening-closing door 21 and the pressing member 22 are also pulled out in the direction of arrow H, and thus separated from the movable guide plate 35 as shown in FIG. 5B. At this time, as shown in FIG. 5C, the movable guide plate 35 is rotated in the direction of arrow F by the elastic force of the movable guide plate applying energy spring, and moves to a position J1. Further, it is possible to manually rotate the handles on both ends of the guide unit 35*a* in the direction of arrow F, thus moving the movable guide plate 35 to a position J2 where, as shown in FIG. 5D, the wheels 35*c* of the movable guide plate 35 collide with the bottom edge of the arc-shaped groove 36*a* of the frames 36.

FIG. 7 is a side view showing a state in which the movable guide plate 35 has been rotated until the wheels 35*c* collide with the bottom edge of the arc-shaped groove 36*a* of the frames 36. FIG. 8 is a rear view showing the movable guide plate 35 in FIG. 7, viewed from direction indicated by arrow E. As shown in FIGS. 7 and 8, when the movable guide plate 35 rotates until the wheels 35*c* of the movable guide plate 35 collide with the bottom edge of the arc-shaped groove 36*a* of the frames 36, the transport path of the recording paper between the heating roller 31 and the pressure roller 32 of the fixing apparatus 12 is widely opened. Thus, as shown in FIG. 5D, it becomes easy to remove recording paper P jammed in the fixing apparatus 12.

After thus removing recording paper P jammed in the transport path, when the opening-closing door 21 is moved by pushing it in the direction of arrow G as shown in FIG. 6, the vertical catches 21*a* and 21*b* of the opening-closing door 21 engage at the respective locations where they engage with the main body of the image forming apparatus AA, thus returning to the original state shown in FIG. 1.

At the same time, the guide of the opening-closing door 21 and the pressing member 22 press against the movable guide plate 35 in the direction of arrow G, so that the movable guide plate 35 rotates in the opposite direction of arrow F and is positioned at the original prescribed position, thus entering a state in which it is possible to guide recording paper between the paper separation plate 33 and the movable guide member 35.

When the opening-closing door 21 is pulled out in the direction of arrow H in this manner, the guide of the opening-closing door 21 and the pressing member 22 separate from the movable guide plate 35 of the fixing apparatus 12, so the movable guide plate 35 is moved in the direction of arrow F by the elastic force of the movable guide plate applying energy spring, and it is further possible to manually move the movable guide plate 35 in the direction of arrow F. In this state, the transport path of the recording paper in the fixing apparatus 12 is widely opened, so it is possible to easily remove recording paper jammed here.

In the fixing apparatus 12 of the present embodiment, the movable guide member 35 rotates along the circumferential face of the pressure roller 32, so the space for moving the movable guide member 35 is limited to the vicinity of the circumferential face of the pressure roller 32. This space is significantly less than the space for evacuating the guide member 103 in the fixing apparatus according to the related art shown in FIG. 9, and does not hinder a reduction in the size of the image forming apparatus AA. Also, even in a state in which the guide member 35 has been positioned to the prescribed position when guiding the recording paper as shown in FIG. 2, the amount of space occupied by the guide member 35 is small, so the guide member 35 does not hinder a reduction in the size of the image forming apparatus AA.

Also, in the vicinity of the circumferential face of the pressure roller 32, from the start a certain amount of space is insured in order to avoid contact between the pressure roller 32 and other members, so it is easy to increase the space in which the movable guide plate 35 moves. Thus, it is possible to widely open the transport path of the recording paper by moving the movable guide plate 35 a large amount, so it is easy to remove the recording paper. In an actual image forming apparatus, the maximum rotation angle of the guide member 103 in the fixing apparatus according to the related art shown in FIG. 9 is about 37 degrees, but the maximum rotation angle of the movable guide plate 35 in the fixing apparatus 12 according to the present embodiment is about 46 degrees, so in the present embodiment it is possible to more widely open the transport path of the recording paper.

Moreover, the present invention is not limited to the above embodiment; various modifications are possible. For example, the ends of the joint shafts 35*b* of the movable guide plate 35 are axially supported with the shaft 32*a* of the pressure roller 32, but the movable guide plate 35 may be supported with any structure as long as it is possible to match the center of rotational movement of the movable guide plate 35 to the shaft 32*a* of the pressure roller 32 and rotate the movable guide plate 35 along the circumferential face of the pressure roller 32.

Also, in the above embodiment the movable guide plate 35 is provided in the pressure roller 32, but depending on the position of the heating roller 31 and the pressure roller 32, the movable guide plate 35 may be provided in either the heating roller 31 or the pressure roller 32. Alternatively, it is possible to provide a movable guide plate in both the heating roller 31 and the pressure roller 32.

The present invention may be embodied in various other forms without departing from the gist or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A fixing apparatus in which while recording paper is transported sandwiched between a heating roller and a pressure roller that are pressed against each other, the recording paper is guided by a guide member, and heat and pressure are applied to the recording paper to fix toner on the recording paper, wherein the guide member is rotatably provided such that the guide member can be removed from the transport path of the recording paper, and the center of rotational movement of the guide member is matched with a shaft of the heating roller or a shaft of the pressure roller;

an opening-closing door is provided in the vicinity of the transport path of the recording paper, wherein when the opening-closing door is closed, the guide member is positioned due to the guide member making contact with part of the opening-closing door; and an applying energy means is provided that, when the opening-closing door has been opened, applies energy to rotate the guide member in a direction that removes the guide member from the transport path of the recording paper.

2. The fixing apparatus according to claim 1, wherein the guide member is rotatably supported by a shaft of the heating roller or a shaft of the pressure roller.

* * * * *